United States Patent [19]

Amlinsky et al.

[11] Patent Number: 4,781,145

[45] Date of Patent: Nov. 1, 1988

[54] DETONATION DEPOSITION APPARATUS

[76] Inventors: Roman A. Amlinsky, Kievskaya ulitsa, 24, kv.I26; Alexei A. Goncharov, I-y Zborovsky pereulok, 17, kv.I4; Vladimir E. Nedelko, Orekhovy bulvar, II, korpus I, kv.256; Jury P. Fedko, Krasnodarskaya ulitsa, 65/I8, korpus I, kv.5 all of, Moscow, U.S.S.R.

[21] Appl. No.: 47,913

[22] PCT Filed: Jul. 25, 1986

[86] PCT No.: PCT/SU86/00073

§ 371 Date: Mar. 23, 1987

§ 102(e) Date: Mar. 23, 1987

[87] PCT Pub. No.: WO87/00453

PCT Pub. Date: Jan. 29, 1987

[30] Foreign Application Priority Data

Jul. 26, 1985 [SU] U.S.S.R. ..... 3922680

[51] Int. Cl.[4] ..... B05B 17/04

[52] U.S. Cl. ..... 118/620; 118/302; 118/326; 427/423; 98/115.3; 239/81; 72/56

[58] Field of Search ..... 118/47, 50, 733, 326, 118/620, 302; 427/423, 422, 425; 98/115.3; 239/81, 85, 79; 72/56

[56] References Cited

U.S. PATENT DOCUMENTS

| | | | |
|---|---|---|---|
| 2,714,563 | 8/1955 | Poorman et al. | 239/85 X |
| 2,869,924 | 1/1959 | McGill | 239/81 |
| 2,950,867 | 8/1960 | Hawley et al. | 239/79 |
| 3,342,048 | 9/1967 | Johnson et al. | 72/56 |
| 3,461,268 | 4/1967 | Inoue | 118/718 X |
| 3,464,249 | 9/1969 | Klein | 72/56 |
| 3,552,653 | 1/1971 | Inoue | 239/81 |
| 3,974,939 | 8/1976 | Melton, Jr. et al. | 222/1 |
| 4,100,783 | 7/1978 | Gambarov et al. | 72/56 |
| 4,504,945 | 3/1985 | Dubust et al. | 427/423 X |

FOREIGN PATENT DOCUMENTS

| | | | |
|---|---|---|---|
| 3128821 | 6/1985 | Fed. Rep. of Germany . | |
| 0605361 | 6/1984 | U.S.S.R. . | |
| 2102309 | 2/1983 | United Kingdom . | |
| 2103112 | 2/1983 | United Kingdom | 239/81 |

OTHER PUBLICATIONS

"Waging War on Wear with Plasma Coatings", Canadian Paint and Finishing, Oct., 1969, pp. 26–29.

*Primary Examiner*—Shrive Beck
*Assistant Examiner*—Alain Bashore
*Attorney, Agent, or Firm*—Lilling & Greenspan

[57] ABSTRACT

A detonation deposition apparatus has a sound insulated deposition chamber and a sound insulated plenum ventilation chamber communicating with the deposition chamber, detonation equipment, and a means for moving a workpiece with respect to the end of a barrel of the detonation equipment and having a drive. The barrel is located outside the deposition chamber and its end is received in the deposition chamber through a sealed inlet. The drive is located outside the deposition chamber and is coupled to the means for moving the workpiece by means of a member effecting mechanical coupling through a sealed inlet. An inlet port of the ventilation chamber is provided with a slide valve and a means for scavenging the chambers with compressed air.

2 Claims, 3 Drawing Sheets

DETONATION DEPOSITION APPARATUS

FIELD OF THE INVENTION

The invention relates to coating techniques, and more specifically it deals with detonation deposition apparatuses.

DESCRIPTION OF THE PRIOR ART

Known in the art is a detonation deposition apparatus comprising a sound insulated deposition chamber having a loading opening provided with a movable cover plate which sealingly closes the opening, a plenum ventilation port and an exhaust ventilation port which communicates with atmosphere through an exhaust ventilation system; a sound insulated plenum ventilation chamber having an inlet port and communicating with the deposition chamber through a plenum port of the deposition chamber and with atmosphere through the inlet port and accommodating said exhaust ventilation system; and deposition equipment all accommodated in the deposition chamber and comprising a barrel with an open end communicating with a gas supply system, a batcher of a pulverulent material being deposited and a spark plug, and a means for moving a workpiece with respect to the barrel end which has an electric drive and which is also accommodated in the deposition chamber (cf. International application PCT/SU 85/00021 filed on Mar. 27, 1985).

The walls of the deposition chamber and cover plate of the loading opening in this apparatus are multilayer walls and consist of steel structures with a large mass-to-surface ratio; they are lined with a continuous layer of a sound absorbing material protected with glass fabric and metal net on the side facing towards the deposition equipment, which is a powerful source of noise.

The plenum ventilation chamber walls consist of an outer sheet lining which is internally lined with a sound absorbing material protected with glass fabric and metal net.

The ventilation chamber has a large inner surface, a rather large capacity and adjoins to the wall of the deposition chamber in which the plenum and exhaust ports are provided. The exhaust ventilation system comprises means for cleaning exhaust gases (cyclones) offering a high hydraulic resistance, the free opening of the exhaust air intake of the ventilation system being located in the deposition chamber, in the zone of the open end of the barrel.

Muffling noise generated during operation of the detonation deposition equipment is a very complicated technical problem due to both high general noise level (up to about 140 dBA) and the fact that there is a substantial share of powerful low- and medium-frequency components (in the 32–1000 Hz range) in the pulse noise spectrum, the sound waves at these frequencies moving freely around barriers and passing through slits and apertures (diffraction).

The sound insulation structure in the prior art apparatus makes it possible to lower noise level at all sound frequencies to about 80 dBA. Acoustic oscillations emerging from the plenum port of the deposition chamber are effectively muffled in the plenum chamber owing to an abrupt expansion of the oscillations front in the interior space of the chamber and cooperation with the sound absorbing surface of the walls. The arrangement of the air ducts of the exhaust ventillation system in the sound insulated space of the plenum chamber in combination with the means of cleaning exhaust gases offering a high hydraulic resistance ensures muffling of noise reaching the exhaust port.

This apparatus features a large size of the deposition chamber, it is unwieldy, rugged and heavy-weight, thus hampering the manufacture, assembly and installation and resulting in a substantial production cost. Accommodation of the deposition equipment in the deposition chamber results in difficulties associated with maintenance of the equipment. It is not altogether possible to ensure the real-time adjustment of the batcher of pulverulent material being deposited during deposition of the apparatus.

Accommodation of the electric drive of the means for moving the workpiece in the deposition chamber adversely affects operability and reliability of the drive and impairs safety of the apparatus.

Complete removal of dust (non-deposited particles of the powder) by the exhaust ventilation system is practically impossible. This results in the mechanisms being contaminated with abrasive particles and causes failures and faults. Various components of the drive may also be overheated under the action of detonation products. The electric motors of the drive are eventual sources of extraneous (inadvertent) ignition with inadequate ventilation so as to result in an emergency situation in the gas supply system.

The prior art apparatus cannot guarantee safe starting after a long-term suspension of operation. Emergency fuel gas leakages in case of faulty (inadequately sealed) valves in the gas supply system may result in a gradual accumulation, e.g. of acetylene, in the interior space of the deposition chamber, pluenum chamber and in the air ducts of the exhaust ventilation system. With a long-term leakage period, an explosive concentration of fuel gas may be built-up. Starting the apparatus, including even the starting of the exhaust fan only, under such circumstances may result in an explosion with destructive consequences.

A detonation deposition apparatus is also in use in the USSR which comprises a sound insulated deposition chamber having a loading opening provided with a sound insulating cover plate, a plenum ventilation port and an exhaust ventilation port which communicates with atmostphere through an air duct system of exhaust ventilation; a sound insulated plenum ventilation chamber having an inlet port and communicating with the deposition chamber through the plenum ventilation port and with atmosphere through the inlet port; and deposition equipment comprising a barrel with an open end communicating with a batcher for pulverulent material being deposited, a gas supply system and a spark plug which are provided outside the sound insulated chambers, and a means for moving a workpiece with respect to the barrel end accommodated in the deposition chamber and a drive mechanically connected to said means. The barrel of this prior art apparatus is located in the ventilation chamber and is connected to the batcher, gas supply system and spark plug by means of connecting lines. The plenum ventilation chamber comprises a casing which surrounds the barrel in a spaced relationship therewith and has openings in the periphery for the passage of said connecting lines and a number of inlet ports of the end face for the admission of ventilation air. The exhaust ventilation port of the deposition chamber is provided with a sound protection screen which is mounted on the deposition chamber upstream of the exhaust port.

This apparatus is of a smaller size and has a lower weight of the deposition chamber as compared to the previously described apparatus, and is easier to manufacture and install.

However, the reduction of the deposition chamber capacity in this apparatus results in a greater explosion hazard since the explosive concentration of fuel gas can be built-up faster in a smaller space of the chamber.

Explosion upon starting can be caused by the electric motor of the exhaust ventilation system fan and also by a fault in the fan, e.g. by sparking.

With inadequate ventilation and a spark plug failure, explosion may occur during operation of the apparatus. The electric drive of the means for moving the workpiece may also be the cause of explosion.

The apparatus provides for prompt and convenient access to the batcher, gas supply system and spark plug because they are located outside the sound insulated chambers. However the maintenance of the barrel proper is associated with labour-consuming dismantling of the plenum ventilation chamber. The provision of the plenum ventilation chamber in the form of the casing surrounding the barrel in a spaced relationship therewith results in a substantial increase in the length of the connecting lines between the barrel and the batcher, gas supply system and spark plug. This impairs operability of the deposition equipment and complicates its structure. Thus, means should be provided to prevent powder of the material being deposited from settling-down and caking in the long connecting line, to ensure optimum compactness of a batch of powder fed to the barrel, and means for ensuring efficient cooling of the line connecting the gas supply system to the barrel so as to avoid self inflammation of fuel mixture in the line. The provision of the spark plug outside generally implies its installation in the line connecting the gas supply system to the barrel. For this reason detonation occurs also in this line and not only in the barrel. Since the line is of a considerable length, particles of the powder, which will inevitably settle down in the line, would gain a sufficient energy to be deposited on the inner surface of the barrel opposite to the inlet opening of the line. As a result the barrel is rapidly contaminated, the build-up of the deposit being the cause of self ignition of the fuel mixture. On the other hand, the deposition range cannot be varied by the simplest means of moving the barrel in this apparatus. This cannot be done because of the casing in which the process openings cannot be made in the form of elongated apertures as this would considerably impair sound insulation. Finally, if it is necessary to modify the lay-out of the deposition equipment (to change position and relative orientation of the batcher, gas supply system and spark plug with respect to the barrel), it would entail a change in the design of the plenum ventilation chamber in this apparatus, i.e. a special casing is required for each specific type of the deposition equipment. This restricts production capabilities of the apparatus and results in an increased cost of its practical application.

The apparatus features inadequate sound insulation. Acoustic oscillations are radiated by diffraction into the outer space through unsealed process openings in the casing which are provided for the passage of connecting lines. In addition, the acoustic protection of the exhaust port by means of the sound absorbing screen can be but partially effective in view of the abovementioned diffraction of low-frequency acoustic waves.

Finally, this apparatus cannot provide for efficient enough removal of particles of non-deposited material from the deposition chamber so that conditions for operation of the drive for moving the workpiece are impaired and explosion hazard of the apparatus increases. The sound absorbing screen provided upstream of the exhaust port constitutes a barrier in the path of movement of the powder particles removed from the chamber. This results in their accumulation in the interior space of the deposition chamber. A number of metal powders are capable of exploding under the action of detonation products. Deposition of powder on the mechanisms of the drive of the means for moving the workpiece materially impairs its operability and calls for a sophisticated system of protection.

SUMMARY OF THE INVENTION

The invention is to improve the structure and relative position of elements of a detonation deposition apparatus in such a manner that, with the reduced size of the apparatus, and in particular, of the deposition chamber and with facilitated operation, safety of starting of the apparatus should be ensured with high efficiency of muffling of noise generated during operation of the detonation deposition equipment.

This problem is solved by a detonation deposition apparatus comprising a sound insulated deposition chamber having a loading opening provided with a cover plate, a plenum ventilation port and an exhaust ventilation port which communicates with atmosphere through an exhaust ventilation system; a sound insulated plenum ventilation chamber having an inlet port and communicating with the deposition chamber through the plenum ventilation port and with atmosphere through the inlet port; and deposition equipment comprising a barrel with an open end communicating with a batcher for a pulverulent material being deposited, gas supply system and spark plug located outside the sound insulated chambers, as well as a means for moving a workpiece with respect to the end of the barrel located in the deposition chamber and a drive mechanically connected to said means. According to the invention, the barrel of the deposition equipment is located outside the sound insulated chambers, the drive of the means for moving the workpiece is located outside the deposition chamber and the latter is provided with two sealed inlets, the open end of the barrel being received in the deposition chamber through one inlet and members ensuring the mechanical connection of the drive to the means for moving the workpiece being received in the deposition chamber through the other inlet, a slide valve and a means for scavenging the chambers with compressed air being provided in the inlet port of the ventilation chamber.

The drive of the means for moving the workpiece is preferably located in the plenum ventilation chamber.

The detonation deposition apparatus according to the invention offers the following advantages:

it ensures reliable and efficient sound insulation as the barrel of the deposition equipment and members ensuring mechanical connection of the drive to the means for moving the workpiece are received in the deposition chamber interior space through sealed inlets in such a manner that the deposition chamber of the apparatus does not have any openings that might directly connect its interior space to the environment so as to let noise out;

the efficiency of sound insulation in the apparatus does not depend on the specific type of deposition equipment because only the part of the barrel with the open end is received in the deposition chamber, the design of both deposition chamber and plenum ventilation chamber being absolutely independent of design and lay-out of the deposition equipment;

the apparatus facilitates maintenance since its basic components in want of maintenance (batcher, gas supply system, spark plug and drive of the means for moving the workpiece) are located outside the deposition chamber with an easy access thereto, and the batch of powder material being deposited and deposition range can be adjusted during deposition without breaking occupational health protection rules as regards the exposure of personnel to noise;

high reliability and operability of the deposition equipment is ensured in this apparatus as the batcher, gas supply system and spark plug can be connected to the barrel without using long connecting lines, because the major part of the barrel is located outside the sound insulated chambers;

the size, total weight and weight of the deposition chamber in this apparatus can be substantially reduced thereby facilitating manufacture and installation and lowering the cost of the apparatus as a whole, since the drive of the means for moving the workpiece is located outside the deposition chamber;

with a comparatively small size of the deposition chamber of the apparatus safe starting of the apparatus is guaranteed (including the case of undetected faults in the gas supply system occurring in non-operative time interval with a fuel gas leakage into the interior space of the deposition chamber), because the slide valve and the means for scavenging with compressed air are provided in the inlet port of the ventilation chamber so as to ensure prestarting scavenging of all interior spaces of the apparatus prior to the starting of the exhaust ventilation system;

an efficient ventilation can be provided in the apparatus since a small size of the deposition chamber makes it possible to ensure a substantial air velocity in the interior space of the deposition chamber; the exhaust ventilation system can even be a plain type (not of the explosion-proof make) since the prestarting scavenging precludes any explosion in the ventilation system upon starting, and explosive concentration of fuel gas cannot be built-up during operation of the apparatus; and the drive of the means for moving the workpiece being located outside the deposition chamber of the apparatus, this drive is reliably protected against the action of heat and powder of the material being deposited without using any structural protective measures complicating the drive; at the same time, the possibility of explosion upon starting of the drive is eliminated.

BRIEF DESCRIPTION OF THE DRAWINGS

The invention will now be described with reference to specific embodiments illustrated in the accompanying drawings, in which.

DETAILED DESCRIPTION

Figure 1:
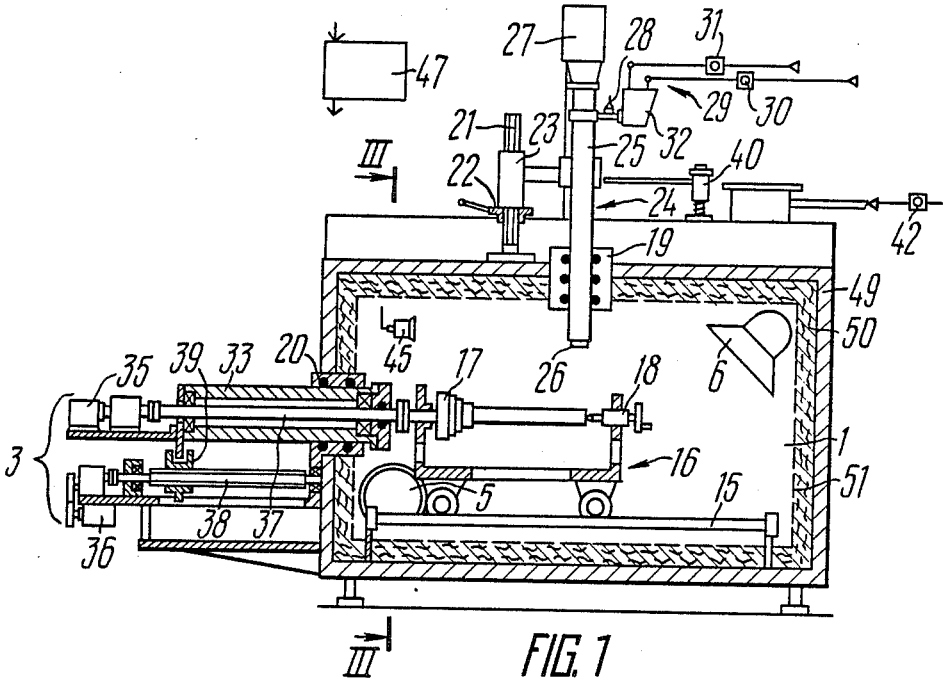
FIG. 1 shows a side view in section of a detonation deposition apparatus.
Figure 2:
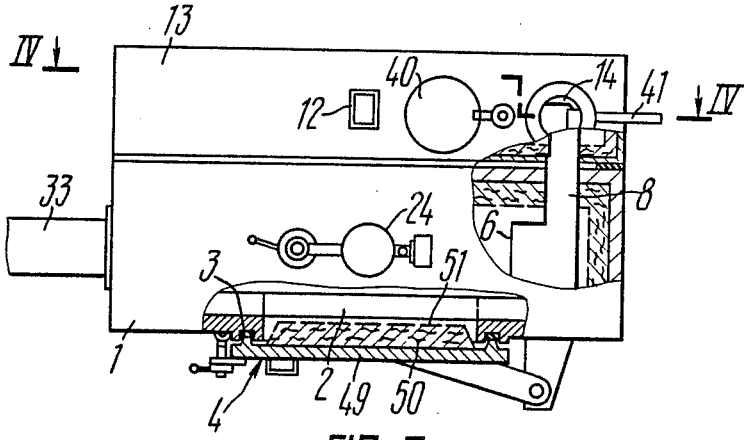
FIG. 2 is a top, plan view of the apparatus shown in FIG. 1.
Figure 3:
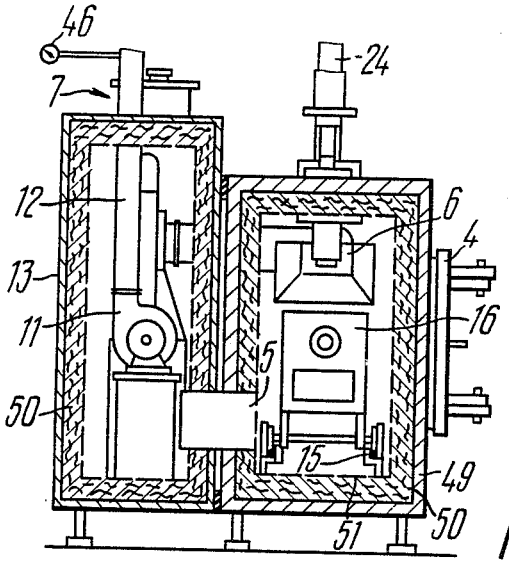
FIG. 3 is a sectional view taken along line III—III in FIG. 1.
Figure 4:
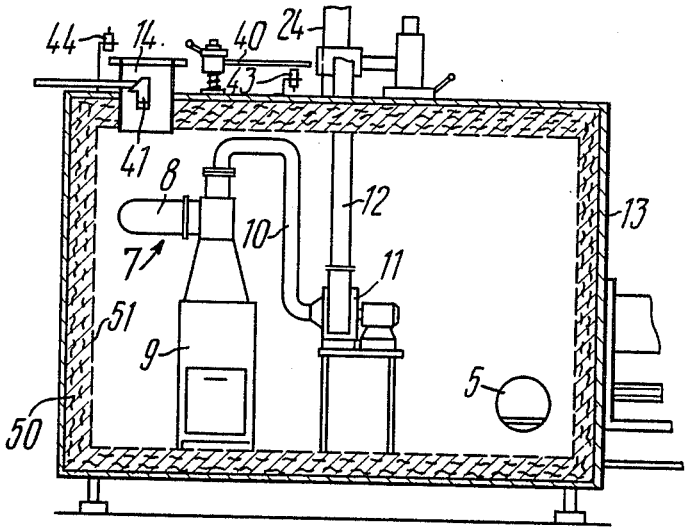
FIG. 4 is a sectional view taken along line IV—IV in FIG. 2.

A detonation deposition apparatus according to the invention comprises a sound insulated deposition chamber 1 (FIGS. 1, 2) having a loading opening 2 (FIG. 2) in one of its side walls and a seal 3 secured along the perimeter of the opening on the outer side of the chamber 1. The opening 2 has a rotatable sound-insulated cover plate 4 which cooperates when closed with the seal 3 and which seals the loading opening 2. The walls of the deposition chamber 1 also have a plenum ventilation port 5 (FIGS. 1, 3, 4) (or a number of plenum ports) and an exhaust ventilation port 6 (FIGS. 1, 2, 3). The plenum port 5 and the exhaust port 6 are spaced at maximum distance possible from each other and are in this specific embodiment in one and the same wall of the deposition chamber 1. The exhaust ventilation port 6 communicates with atmosphere (ambient environment) by means of an exhaust ventilation system 7 (FIG. 4). The exhaust ventilation system 7 is of the sealed type and in this embodiment it comprises an exhaust air intake 8 (FIGS. 2, 4), means 9 for cleaning ventilation air (such as cyclones), a suction air duct 10 connected to an exhaust port of a fan 11 (FIGS. 3, 4) and a discharge air duct 12 extending outside of a production room (not shown). A sound insulated plenum ventilation chamber 13 (FIGS. 2, 3, 4) is sealingly connected to the deposition chamber 1, the upper wall of the plenum chamber having an inlet port 14 (FIGS. 2, 4) for ventilation air which is in the form of a pipe communicating with atmosphere. Communication with atmosphere may be effected, in particular, through a plenum air duct system with a forced air supply by means of a plenum fan (not shown). The relative position of the sound insulated chambers 1 and 13 is such that the chamber 13 communicates with the chamber 1 through the plenum port 5 of the deposition chamber 1.

Guide members 15 (FIGS. 1, 3) are mounted in the deposition chamber 1 for supporting a means 16 (FIGS. 1, 3) for moving a workpiece, which in this case is in the form of a wheel-mounted carriage mounted for linear movement along the guide members 15. The carriage has a chuck means 17 (FIG. 1) which is rotatable about the axis of the chuck means 17 and a support center pin 18. The deposition chamber 1 has two sealed inlets 19 and 20 (FIG. 1) which in this specific embodiment are in the form of sleeves incorporated in the walls of the deposition chamber 1 and provided with seals.

The inlet 19 is located in the upper wall (or "roof") of the deposition chamber 1, the axis of the sealed inlet 19 extending at right angles with respect to the axis of rotation of the chuck means 17 and intersecting this axis. The sealed inlet 20 is coaxial with the chuck means 17. A threaded column 21 (FIG. 1) with a support nut 22 (FIG. 1) is mounted on the wall of the deposition chamber 1 in which the sealed inlet 19 is made. The nut 22 is engageable with a bushing 23 carrying an arm.

The apparatus according to the invention also comprises deposition equipment 24. The deposition equipment 24 comprises a barrel 25 (FIG. 1) with an open end 26 and a batcher 27 for a pulverulent material being deposited, a spark plug 28 and a gas supply system 29 all communicating with the barrel 25. The water-cooled barrel 25 is rigidly secured to the arm of the bushing 23. The gas supply system 29 comprises valves 30, 31 provided in fuel gas and oxygen lines, respectively, and a gas mixer 32. The spark plug 28 (in this specific embodiment) is located in the line of the gas supply system 29 connecting the mixer 32 to the barrel 25.

The mixer 32 and the line in which the spark plug 28 is mounted are water cooled.

The barrel 25 is received in the deposition chamber 1 through the sealed inlet 19 with the possibility of linear movement along the axis of the inlet 19, but in such a manner that in any working position thereof the end portion of the barrel 25 with the open end 26 is within the deposition chamber 1. The remaining part of the barrel 25, together with the batcher 27, spark plug 28 and gas supply system 29, is located outside the sound insulated chambers 1, 13.

A member 33 (FIGS. 1, 2) for effecting the mechanical connection, e.g. in the form of a hollow rod (referred to hereinbelow as the rod 33) is received in the deposition chamber 1 through the sealed inlet 20. The rod 33 is linearly movable along the axis of the inlet 20 and is mechanically coupled to the means 16 for moving the workpiece with respect to the open end 26 of the barrel 25 inside the chamber 1.

A drive 34 of the means 16 for moving the workpiece is located outside the deposition chamber 1 and is also connected to the rod 33. In this specific embodiment the drive 34 comprises a rotatable electric drive 35 and a linear electric drive for moving the workpiece. The drive 34 is constructed in the following manner. An intermediate shaft 37 (FIG. 1) extends within the hollow rod 33 and is rotatable about its axis in bearings provided in the rod 33 (unreferenced). The shaft 37 is mechanically coupled to the chuck means 17 of the means 16 and to the electric drive 35 which is rigidly secured to the rod 33. The electric drive 36 has a screw 38 (FIG. 1) and a motion nut 39, the nut 39 being engageable with the rod 33 for imparting motion thereto. The interior space of the rod 33 and the shaft 37 are protected by means of seals provided on the side of the deposition chamber 1.

The inlet plenum part 14 of the plenum ventilation chamber 13 is provided with a slide valve 40 (FIGS. 1, 2, 4) and with a means 41 (FIGS. 2, 4) for scavenging the chambers 1, 13 with compressed air. The means 41 comprises a compressed air line with an electromagnetic valve 42 (FIG. 1) received in the port 14. The slide valve 40 is capable of sealing the port 14. The open and closed positions of the slide valve 40 are detected by means of slide valve position pick-ups 43, 44 (FIG. 4) which are provided on the plenum ventilation chamber 13. A remote control explosion pick-up 45 (FIG. 1) is provided in the deposition chamber 1 and comprises a microphone or an electromagnetic earphone. A ventilation function control pick-up 46 is provided in the discharge air duct 12 of the exhaust ventilation system 7 and is in the form of a relay transducer converting pressure, head or draft, into electric signal.

The apparatus according to the invention may be provided with a number of auxiliaries (not shown) enhancing safety of its systems, automation and quality of deposition. Thus a means for providing continuous or pulsed auxiliary "open fire"can be provided in the deposition chamber, upstream of its exhaust port 6. This means may be in the form of an electric heater or an auxiliary discharge gap (auxiliary spark plug). An auxiliary noise level sensor (microphone, earphone, noise gauge with electrical output signal) can be provided outside the sound indulated chambers 1, 13. If this sensor is located adjacent to the batcher 27 of the deposition equipment 24, it will also function as a level gauge for sensing the level of a pulverulent material being deposited in the batcher 27. Explosion valves may be provided in the upper wall of the deposition chamber 1. An auxiliary compressed air source may be provided in the interior space of the chamber 1 for blowing the workpiece. The necessity and expediency of the provision of the abovementioned auxiliaties depend on specific application of the detonation deposition apparatus.

The detonation deposition apparatus is provided with an electric control system 47 (FIG. 1) in the form of a combination of data processing and command generation means. The system 47 is built around industrial electronic components such as a programmed master controller or a microcomputer. The abovementioned pick-ups 43, 44, 45, 46 and valves 30, 31, 42 are electrically coupled to the electric control system 47. When auxiliaries are used in the apparatus ("open fire"means, noise level sensor), these auxiliaries are also connected to the system 47.

Figure 5:
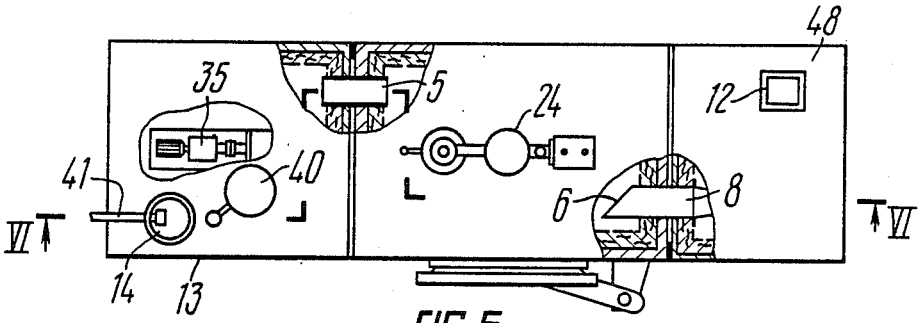
FIG. 5 is a top plan view of another embodiment of a detonation deposition apparatus having a drive of the means for moving a workpiece located in a ventilation plenum chamber.
Figure 6:
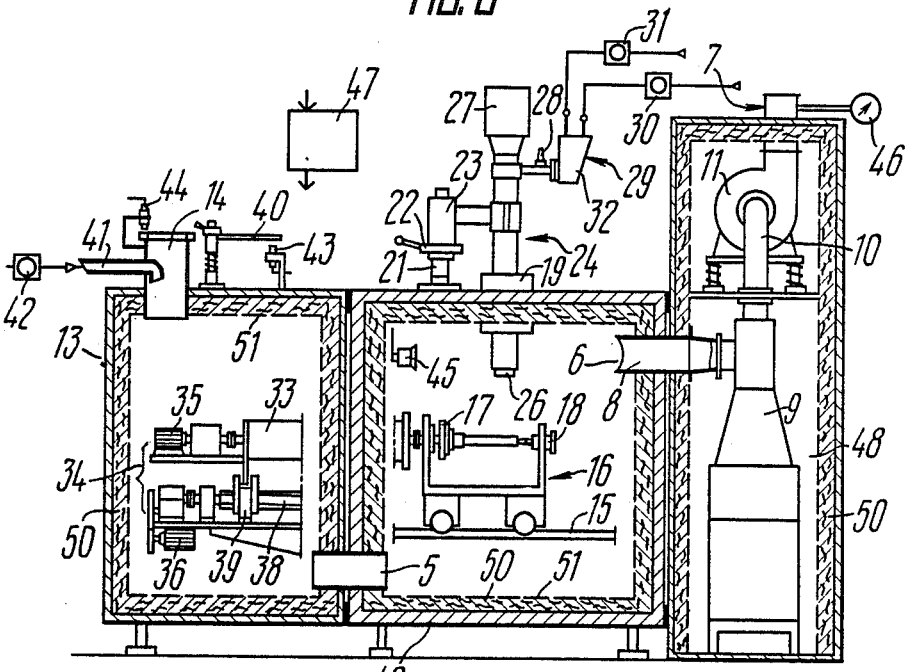
FIG. 6 is a sectional view taken along line VI-VI in FIG. 5.

Another embodiment of the detonation deposition apparatus according to the invention shown in FIGS. 5, 6 is similar to the embodiment shown in FIGS. 1 through 4, with the only difference that the drive 34 of the means 16 for moving the workpiece in the deposition chamber 1 is mounted in the plenum ventilation chamber 13, and the members of the exhaust ventilation system 7 - cleaning means 9, suction air duct 10 and the fan 11 as well as a part of the discharge air duct 12 are provided in an auxiliary sound insulated casing 48. The casing 48 sealingly connects to the wall of the disposition chamber 1 in which the exhaust port 6 is made. In this embodiment the apparatus according to the invention has a more rational lay-out. The deposition chamber 1 is made in the form of a welded steel structure based on a continuous rugged (thick-sheet) framework 49 made of steel (FIGS. 1, 2, 3, 6). The framework may also be made in the form of a structure with double metal walls, the space between the walls being filled with a bulk material (such as sand). The framework 49 is internally provided (on the side facing towards the open end 26 of the barrel 25) with mats of a sound absorbing material 50 in a glass fabric envelope, which are protected with a thin perforated steel or duralumin sheet 51.

The sound insulated movable cover plate 4 is made in a similar manner (FIG. 2). The sound insulation of the ventilation chamber 13 (FIGS. 3, 4) and auxiliary casing 48 (FIGS. 5, 6) is constructed as described above, with the only difference that the metal framework is much less rugged (thin-sheet).

The detonation deposition apparatus functions in the following manner.

Before starting operation, the apparatus should be in the starting position with the closed slide valve 40 (when the slide valve tightly seals the inlet port 14 of the ventilation chamber 13) and with the sealingly closed sound insulated cover plate 4.

The control system 47 is switched on. As the slide valve 40 is closed, the pick-up 44 disables the starting of the exhaust ventilation system 7 (and more specifically, of the fan 11). The absence of a signal from the ventilation function pick-up 46 will, in turn, disable the starting of the drive 34 of the means 16 for moving the workpiece (and more specifically, the starting of gas supply system 29 and spark plug 28) following the command of the control system 47. Following the command of the control system 47, the valve 42 of the means 41 for scavenging the interior spaces of the apparatus is opened. Compressed air will flow freely out of the scavenging means 41. As the slide valve 40 and cover plate 4 are sealingly closed, and the barrel 25 is received in the deposition chamber 1 through the sealed inlet 19 and the rod 33 is received in the same chamber through the sealed inlet 20, the air can only escape through the exhaust port 6 and the exhaust ventilation system 7. The air will successively fill up the plenum ventilation chamber 13 (from top down) and then it will be admitted through the plenum inlet port 5 to the deposition chamber 1 to get therefrom, via the exhaust port 6, into the exhaust ventilation system 7 and then into atmosphere outside the production room. Following a preset time delay and a signal from the control system 47, the valve 42 of the scavenging means 41 is closed, and the prestarting scavenging is stopped. The prestarting scavenging guarantees safety of further starting irrespective of the condition of the gas supply system 29 of the deposition equipment 24 after long-term non-operative periods of the apparatus (including regular rest periods). If an explosive concentration of fuel gas is built-up in the deposition chamber 1 and in the plenum chamber 13, as a result of an undetected emergency gas leakage (e.g. in case of the faulty fuel gas valve 30), this concentration continually decreases during air scavenging, and with an adequate scavenging time, the content of fuel gas in the interior space of the chambers 13, 1 will be lowered to a safe level. It should be noted that neither the deposition equipment 24 nor the electric motors 35, 36, nor even the exhaust fan 11, can be started until the scavenging is over, i.e. there is no possibility of ignition and detonation in the chamber 1, 13 initiated by any possible cause. The scavenging time necessary for ensuring safety of the apparatus depends on the capacity of the interior space of the chambers 1, 13 and the exhaust ventilation system. Thus, if the diameter determining air flow from the means 41 is 10 mm, the capacity of the abovementioned spaces is 0.8 $m^3$, and the initial acetylene concentration (fuel gas concentration) in the interior space of the chamber 1 as a result of emergency leakage is 70%, the scavenging time should be at least 3.5 minutes. After the 3.5 minutes scavenging acetylene concentration will drop to the safe level of 1.5%. This example shows that scavenging of sound insulated chambers with compressed air (as the method of ensuring safety of starting) is expedient, first of all, for a comparatively small capacity (size) of the chambers 1 and 13. As the fan 11 and its electric motor 11 are inoperative during scavenging, the fan and its drive can be of conventional make (not explosion-proof).

When the scavenging is over, the slide valve 40 is opened, and the plenum ventilation chamber 13 communicates with atmosphere through the inlet port 14; a signal is fed from the slide valve position pick-up 43 to enable starting of the fan 11. The fan 11 is switched on following the command from the control system 47, and this fan will function continually until detonation deposition operation in the apparatus is completed. The flow of ventilation air moves through the inlet port 14 and is removed through the exhaust port 6 of the deposition chamber 1 by means of the exhaust ventilation system 7. A gauge pressure with respect to the deposition chamber 1 is built-up in the plenum ventilation chamber 13. As soon as the head (draft or pressure) in the discharge air duct 12 of the system 7 reaches a permissible level, the ventilation function pick-up 46 actuates. This enables the starting of the drive 34 and deposition equipment 24 following the command from the control system 47. Following this, any falt or trouble in the ventilation system 7 resulting in a drop of head (pressure or draft) below the level monitored by the pick-up 46 will result in an immediate deenergization of the deposition equipment 24 and drive 34.

After the ventilation system has been switched on, the operator opens the cover plate 4 of the chamber 1 and loads a workpiece into the means 16 for moving the workpiece through the loading opening 2 of the deposition chamber 1. The workpiece is secured in the chuck means 17 and is pressed by the center pin 18 if necessary. Then the initial position of the workpiece with respect to the open end 26 of the barrel 25 of the deposition equipment 25 is set by moving the carriage of the means 16 along the guide members 15 (manually or by means of the drive 34). The operator closes the cover plate 4 and, using clamping means (unreferenced) seals the loading opening 2, of the deposition chamber 1. The tight sealing is achieved by pressing the cover plate 4 against the seal 3.

The operator then adjusts the gas supply system 29, turns on cooling water supply to the barrel 25 and gas mixer 32 and sets the desired deposition range. The deposition range in this case is adjusted in the following manner. When the handwheel nut 22 is rotated, the support bushing 23 moves together with the barrel 25 along the threaded column 21. The barrel 25 moves along the axis of the sealed inlet 19 of the deposition chamber 1. The tight sealing of the deposition chamber 1 is not broken. It will be apparent that with the abovedescribed lay-out of the deposition equipment 24 and sound insulated chambers 1, 13 there is nothing to hamper the adjustment of the deposition range (i.e. the position of the open end 26 of the barrel 25 with respect to the workpiece) directly during deposition if necessary.

Then, following a signal from the control system 47, the deposition equipment 24 is switched on, and the drive 34 of the mean 16 for moving the workpiece is energized. The valves 30, 31 of the gas supply system are opened. Fuel gas and oxygen are continually fed to the gas mixer 32. The working gas mixture is admitted from the mixer 32 to the barrel 25 and fills it. When the barrel 25 is completely filled, i.e. at the moment when the gas mixture reaches the open end 26, a discharge pulse is fed to the discharge gap of the spark plug 28 following the command from the control system 47. Detonation develops in the barrel 25. It should be noted that in this embodiment of the apparatus, the batcher 27 of the deposition equipment 24 does not work during the first detonation cycle, and no coating is applied. Detonation products will act upon the powder of the material being deposited which is available in the batcher 27 to advance the prepared batch of the powder into the barrel 25. During the second and further detonation cycles the powder being deposited, which has been admitted to the barrel 25, will be accelerated to a high velocity and fused through under the action of detonation products. The powder particles darting out of the open end 26 will impinge upon the workpiece surface to produce a coating thereon. As the type of the deposition equipment 24 in this apparatus does not depend on the size and location of the sound insulated chambers 1, 13 (except for the diameter of the sealed inlet 19 and outside diameter of the barrel 25), high reliability and operability of the deposition equipment 24 are obtained. The length of the connecting lines connecting the batcher 27, mixer 32 and spark plug 28 to the barrel 25 will depend in this apparatus only on the structural arrangement of the deposition equipment 24. As a result, problems associated with powder caking and instability of, or inadvertent, ignition of the mixture, barrel clogging opposite to the point at which the fuel mixture is admitted are eliminated or minimized.

At the same time, as the batcher 27, spark plug 28 of the gas supply system are located outside the sound insulated chambers 1, 13, maintenance operations and parts replacement are greatly facilitated and accelerated. Free access to the batcher 27 enables mechanical adjustment of the batch volume of the powder (deposition capacity) even during the deposition since sealing of the deposition chamber 1 is not disrupted during the batch volume adjustment so that labour conditions for operator remain unchanged. As mentioned above, there is an opportunity of adjusting the deposition range during the deposition process. The location of the major part of the barrel 25 outside the sound insulated chambers 1, 13 facilitates its maintenance, in particular cleaning since there is no need to dismantle the equipment 24.

Each detonation pulse is accompanied by a powerful noise. This noise is detected by the pick-up 45 forming an electric signal. The signal is handled by the electric control system 47 in such a manner that if the time interval between the arrivals of successive signals from the explosion pick-up 45 corresponds to the preset frequency of ignition (i.e. to the frequency of pulses fed from the electric control system 47 to the spark plug 28), the valves 30, 31 of the gas supply system 29 are held open.

However, if the spark plug 28 fails, or if combustion breaks through back into the gas mixer 32 (so called "flame breakthrough"), there will be no next detonation, nor will an acoustic pulse appear which would normally accompany an explosion. If there if no noise during a time inverval which is 40–50% longer than the preset working interval between detonation pulses ("shots"), the control system 47 will close the valves 30, 31 and the gas supply is interrupted. The drive 34 will also be switched off. Therefore, the admission of unreacted (explosion hazardous) mixture to the deposition chamber 1 or combustion in the gas mixture 32 can only occur during but a very short time (0.5 s at maximum), provided the valves 30 and 31 are tightly sealed.

This is important from the point of view of both eventual failure of the gas mixer 32 and the fact that the capacity of the deposition chamber 1 is conparatively small in this apparatus. With the ventilation system in operation, an explosive concentration of fuel gas cannot be built-up in the deposition chamber during so a short time.

The noise that accompanies detonation pulses in the barrel 25 is mainly and decisively an aerodynamic noise. This means that the water-cooled barrel 25 proper and all other components of the equipment 24 will always have such rigidity, mass and structure that the acoustic source is in the open end 26 of the barrel 25.

Sound insulation in the apparatus is effected in the following manner. Acoustic waves first propagate from the open end 26 of the barrel 25 within the sound insulated deposition chamber 1. The noise here is lowered, first, through dissipation of acoustic energy in the pores of the sound absorbing material 50, and second, by way of multiple reflections and dissipation of acoustic energy when acoustic waves interact with the rugged continuous framework 9 (which has a high mass-to-surface ratio). The efficiency of absorption of sound penetrating through perforation of the sheet 51 into the sound absorbing material 50 is greater for high- and medium-frequency components of spectrum of the resultant acoustic oscillations (for frequencies of 1000 Hz and above). For acoustic oscillations in the range from 250 to 1000 Hz the mass of the framework 49 is critical, and for acoustic waves in the range from 32 to 250 Hz rigidity of the framework 49, and not only its mass, is of a decisive importance.

It should be noted that for acoustic oscillations at all frequencies, from the point of view of sound insulation, the tightness of sealing of the deposition chamber is highly crucial. The direct emergence of acoustic waves from the deposition chamber 1 into the production room may compromise all sound insulation measures. It is, therefore, important that the sound insulated cover plate 4 in this apparatus sealingly closes the opening 2 and that the inlets 19, 20 are tightly sealed.

It should be also noted that the components of the deposition equipment 24 (the gas mixer 32, spark plug 28, batcher 27 on the one hand and the barrel 25 on the other) connect to each other in a tightly sealed manner and the internal joints are also scaled. This is important not only from the point of view of noise, but also from the safety standpoint.

Acoustic oscillations in this apparatus can emerge from the deposition chamber 1 only through the plenum port 5 and exhaust port 6.

However, when the acoustic waves (already attenuated) penetrate through the plenum port 5, the front of the acoustic wave is expanded at the outlet tinto the plenum ventilation chamber 13, and a part of the energy is lost. Then the sound interacts through perforation of the sheet 51 with the large sound absorbing surface 50 of the plenum chamber 13 to be finally dampened.

It should be noted that the axes of the plenum port 5 of the chamber 1 and inlet port 14 of the chamber 13 extend at right angles to each other so as to avoid a so called "beam" outlet of sound. Efficiency of sound insulation as regards the sound energing through the port 5 depends on the volume and surface area of the sound insulated chamber 13.

These parameters in this apparatus are in no way connected with the position and lay-out of the deposition equipment 24. Since the surface area of the sound absorbing material 50 in the chamber 13 of this apparatus is large enough, the noise level at the outlet, i.e. adjacent to the port 14 will be even lower than the noise level at the workplace of the operator (in front of the cover plate 4) and will be 78 dBA.

Acoustic oscillations penetrating to the exhaust port 6 propagate through the exhaust ventilation system 7, and more specifically, through the exhaust air intake 8, cleaning means 9, suction air duct 10, fan 11 and discharge air duct 12. However, all these components are also enclosed in sound insulated envelopes so that the noise penetrating into the system 7 will not emerge outside the apparatus. In the embodiment of the apparatus shown in FIGS. 1 through 4 this is the space of the plenum chamber 13, and in the embodiment of the apparatus shown in FIGS. 5, 6 this is the auxiliary sound insulated casing 48. In addition, such components of the system 7 as the cleaning means 9 (such as cyclones) and fan 11 are powerful barriers in themselves which appear in the path of aerodynamic noise as they offer a high hydraulic resistance (reactive mufflers). It should be, however, noted that the fan 11 which is a medium- or high-pressure fan (i.e. a high-speed fan) is itself a source of additional noise. This noise is incomparable with the noise generated by detonation pulses, and it takes placing the fan 11 in the sound insulated interior of the chamber 13 or casing 48 as shown in the drawings to suppress this noise.

The noise level in the apparatus as a whole can be lowered to about 80 dBA with the initial noise level of about 140 dBA.

During deposition the powder being deposited, which is projected out of the barrel 25, is not completely utilized for deposition. A substantial amount of powder, namely the particles that do not posses the energy which is sufficient for them to reach the surface of the workpiece and to produce a coating, will be dispersed in the deposition chamber 1. The major part of the "surplus" powder will be trapped by the exhaust ventilation system 7. The particles are entrained with the stream of ventilation air through the exhaust port 6 of the deposition chamber and through the exhaust air intake 8 and will get into the cleaning means 9, (cyclone, filter bags) wherein they are decelerated and settle down. The cleaned air will flow through the suction air duct 10 and will be discharged by the fan 11 through the discharge air duct 12.

Nevertheless, it is not possible to achieve complete removal of powder particles from the chamber 1. The provision of the drive 34 outside the sound insulated deposition chamber 1 eliminates or minimizes clogging of mechanisms and their jamming and prevents impairment of accuracy of motion caused by wear. At the same time, conventional lubricants may be used as the mechanisms of the drive 34 are located outside the zone of thermal factors accompanying the detonation deposition. At the same time, as the drive 34 is located outside the deposition chamber 1, the size of this chamber can be further reduced. This lowers the total weight of the apparatus and consumption of materials for its manufacture and facilitates assembly of the apparatus.

The provision of the drive 34 in the plenum ventilation chamber 13 (FIGS. 5, 6) allows the interior space of this chamber to be utilized to the full extent. In this case the drive 34 is continually blown with the plenum ventilation air which flows from the inlet port 14 of the chamber 13 towards the plenum port 5 of the chamber 1. The powder particles will not get to the mechanisms of the drive 34 since, as mentioned above, there is inevitably a gauge pressure in the chamber 13 with respect to the chamber 1. The electric motors of the drive 34 may not be explosion proof.

The workpiece is moved during deposition in the following manner. The electric rotary drive 35 continually rotates the intermediate shaft 37 which transmits rotation to the chuck means 17 of the means 16. The linear electric motor 36 rotates the screw 38 so that the motion nut 39 will move therealong. The nut 39 will transmit its motion to the rod 33 which moves along the axis of the sealed inlet 20 of the chamber 1. The intermediate shaft 37, which is located in the hollow rod 33, moves together therewith and with the electric motor 35 which is secured to the rod 33. The rotating intermediate shaft 37 will simultaneously move the carriage (means 16) mechanically coupled thereto along the guide members 15. The linear movement may be either stepped or continuous. The movement program may be set by the control system 47. The drive design and operation may be different depending on the shape and size of a workpiece.

It should be noted that the provision of the drive 34 outside the chamber 1 makes it possible to simplify its design since there is no need to protect elements of the drive against finely divided abrasive particles. Maintenance of the drive, its repair and installation are also materially facilitated.

After the deposition is completed, the valves 30, 31 of the gas supply system are closed following the command of the control system, feeding of high-voltage pulses to the spark plug 28 is suspended, the drive 34 is switched off, the cover plate 4 of the deposition chamber 1 is opened, and the finished product is removed from the means 16 for its movement through the opening 2.

After the deposition operations are over (at the end of the workshift) the fan 11 is switched off, the slide valve 40 is set to the initial position (i.e. the slide valve should again sealingly close the inlet port 14), and the cover plate 4 of the deposition chamber 1 is tightly sealed. Then the gas supply system 29 is turned off (the valves of gas sources and the like are closed) and, finally, the control system 47 is switched off as well.

INDUSTRIAL APPLICABILITY

The detonation deposition apparatus is designed for handling small and medium batches of parts in the automotive industry, e.g. for surface improvement of engine parts such as shafts, pivot pins, liners, and components of the fuel suppy system of a vehicle.

The apparatus may also be used in the oil and gas recovery industry for improving parts of drilling equipment and pumping units working under abrasive wear conditions.

The apparatus may be as well used for hard facing of mechanical engineering parts when dealing with comparatively small coated surfaces.

We claim:

1. A detonation deposition apparatus comprising a sound insulated deposition chamber having a loading opening provided with a cover plate, a plenum ventilation port and an exhaust ventilation port which communicates with atmosphere through an exhaust ventilation system; a sound insulated ventilation chamber having an inlet port and communicating with the deposition chamber through the plenum ventilation port and with the atmosphere through the inlet port; deposition equipment comprising a barrel having an open end and communicating with a batcher for a pulverulent material being deposited, a gas supply system and a spark plug which are located outside the sound insulated deposition and ventilation chamber; and a means for moving a workpiece with respect to the end of the barrel and located in the deposition chamber and a drive mechanically coupled to said means; wherein the improvement comprises the barrel of the deposition equipment being located outside the sound insulated deposition and ventilation chambers, the drive of the means for moving the workpiece being located outside the deposition chamber, and the deposition chamber being provided with first and second sealed inlets, the end portion of the barrel having the open end being movably received in the deposition chamber through said first sealed inlet, and a member of the mechanical coupling of the drive to the means for moving the workpiece being received in the deposition chamber through the second sealed inlet, a slide gate and a means for scavenging the deposition and ventilation chambers with compressed air being provided in the inlet port of the ventilation chamber.

2. A detonation deposition apparatus according to claim 1, wherein the drive of the means for moving the workpiece is provided in the plenum ventilation chamber.

* * * * *